US006203359B1

(12) United States Patent
Lee

(10) Patent No.: US 6,203,359 B1
(45) Date of Patent: Mar. 20, 2001

(54) INSULATION DISPLACEMENT CONNECTION CONNECTOR

(75) Inventor: George Lee, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/439,843

(22) Filed: Nov. 12, 1999

(30) Foreign Application Priority Data

Jun. 17, 1999 (TW) ..... 88210079

(51) Int. Cl.[7] ..... H01R 13/58
(52) U.S. Cl. ..... 439/405; 439/459
(58) Field of Search ..... 439/357, 358, 439/404, 405, 407, 435, 456, 459, 470, 492, 499

(56) References Cited

U.S. PATENT DOCUMENTS 4,006,957 * 2/1977 Narozny .
4,359,257 * 11/1982 Lopinski et al. .
4,621,885 * 11/1986 Szczesny et al. .
4,648,677 * 3/1987 Lang ..... 439/459
4,681,382 * 7/1987 Lockard ..... 439/497
4,960,390 * 10/1990 Davis et al. ..... 439/459
5,104,336 * 4/1992 Hatanaka et al. ..... 439/404
5,108,308 * 4/1992 Wellinsky ..... 439/404
5,125,850 * 6/1992 Locati ..... 439/404
5,338,221 * 8/1994 Bowen et al. ..... 439/405
5,664,961 * 9/1997 Tsuji et al. ..... 439/358
5,762,513 * 6/1998 Stine ..... 439/358

* cited by examiner

*Primary Examiner*—Gary F. Paumen
(74) *Attorney, Agent, or Firm*—Wei Te Chung

(57) ABSTRACT

An IDC connector comprises a housing retaining a number of contacts therein, a cover assembled on the housing, and a strain relief attached to the cover. The housing forms a pair of arms at opposite ends thereof. A pair of fasteners is formed at each end of the cover for engaging with the corresponding arm of the housing. The strain relief includes an elongate body and a pair of legs extending from opposite ends of the body. Each leg has a generally U-shaped configuration including a connecting wall between the two side walls. A latch integrally and inwardly projects from an inner face of the connecting wall between the two side walls. Thus, the connection between the latch and the body is improved thereby preventing damage from being incurred on the latch.

1 Claim, 5 Drawing Sheets

INSULATION DISPLACEMENT CONNECTION CONNECTOR

FIELD OF THE INVENTION

The present invention relates to an electrical connector for insulation displacement connection (IDC) with a flat cable, and especially to an IDC connector which reliably connects with a flat cable.

BACKGROUND OF THE INVENTION

A conventional IDC connector includes a housing with a plurality of contacts received therein, a cover assembled on the housing, and a strain relief attached to the cover. A flat cable is secured between the housing and the cover at a distal end thereof for electrically connecting with the contacts by insulation displacement. The cable is then bent and secured between the cover and the strain relief to withstand an external force exerted on the cable thereby ensuring reliable connection between the contacts and the cable. Related examples are disclosed in U.S. Pat. Nos. 4,006,957; 4,681,382; 5,104,336 and 5,762,513.

U.S. Pat. No. 5,762,513 discloses an IDC connector including a cover, a housing and means for securing the cover to the housing. However, the means can not provide a reliable mechanical connection between the cover and the housing and may become easily damaged.

SUMMARY OF THE INVENTION

Accordingly, an object of the present invention is to provide an IDC connector having means for securing a cover to a housing thereof.

To achieve the object mentioned above, an IDC connector of the present invention comprises a housing retaining a plurality of contacts therein, a cover assembled on the housing, and a strain relief attached to the cover. The housing forms a pair of arms at opposite ends thereof. A pair of fasteners is formed at each end of the cover for engaging with the corresponding arm of the housing. The strain relief includes an elongate body and a pair of legs extending from opposite ends of the body. Each leg has a generally U-shaped configuration including two side walls between the two side walls. A latch integrally and inwardly projects from an inner face of the connecting wall between the two side walls. Thus, the connection between the latch and the body is improved thereby preventing damage from being incurred on the latch.

Other objects and advantages of the present invention will be understood from the following description of an electrical card connector according to a preferred embodiment of the present invention shown in the accompanying drawings.

DETAILED DESCRIPTION OF THE PREFERRED EMBODIMENT

Figure 1:
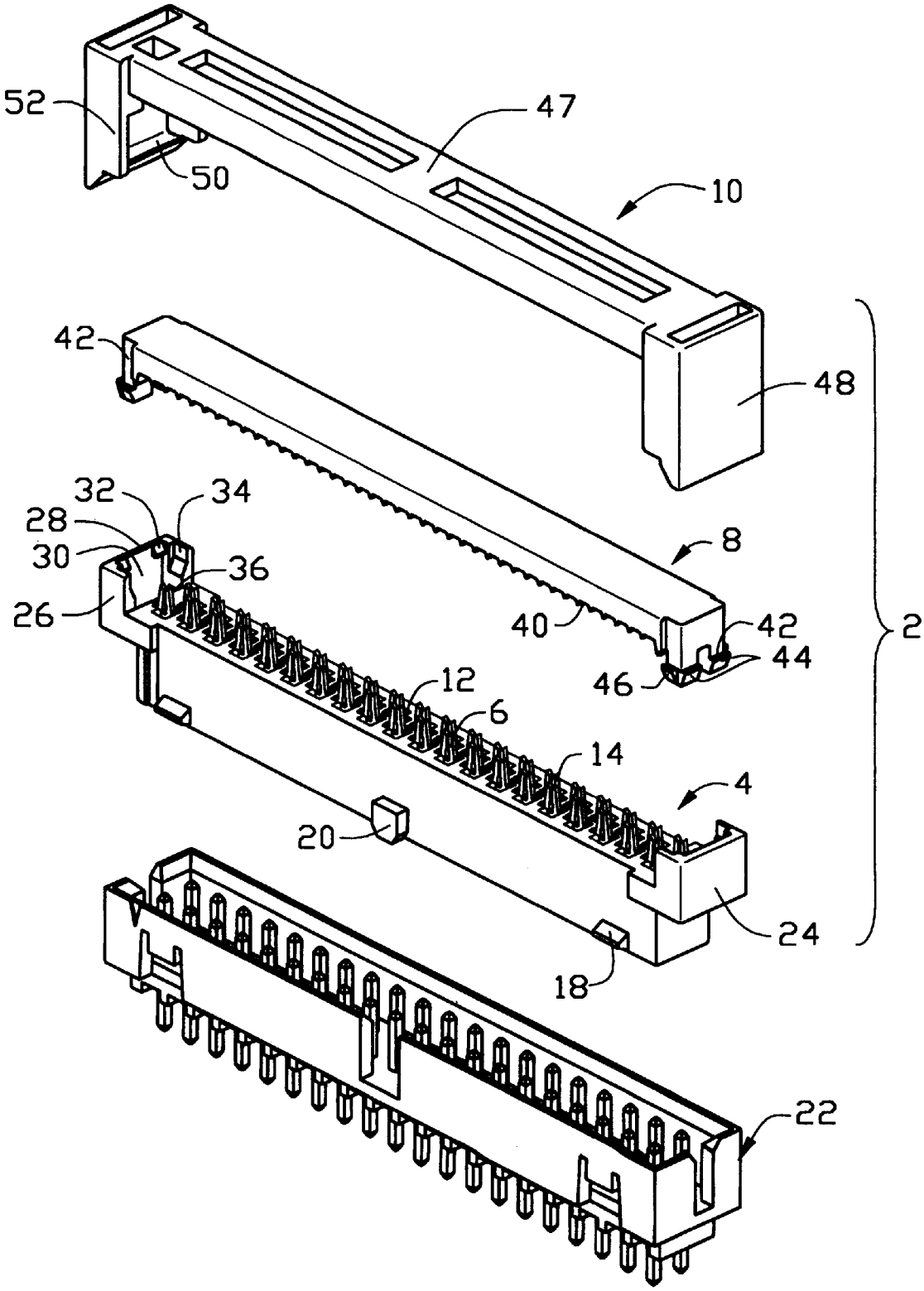
FIG. 1 is an exploded view of an IDC connector embodying the concepts of the present invention and a complementary connector.
Figure 2:
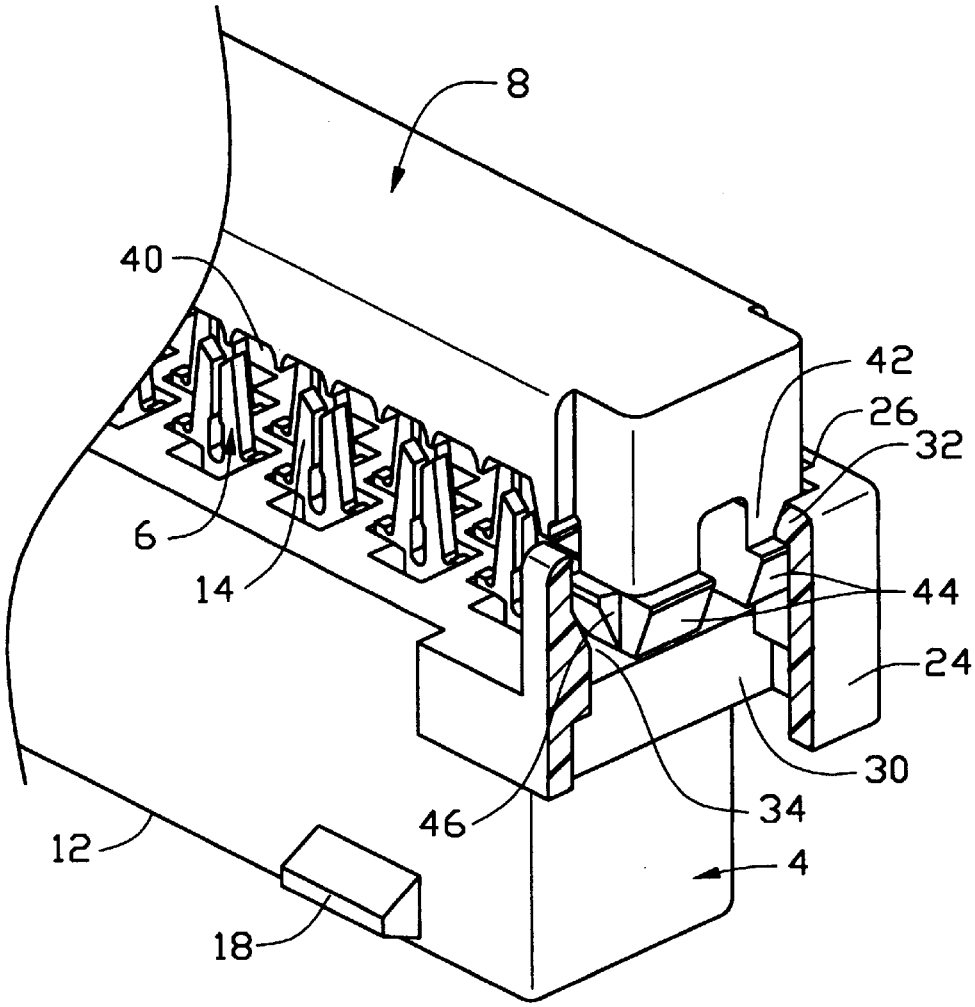
FIG. 2 is a fragmentary assembled view of a cover and a housing of the IDC connector with the cover initially engaged with the housing.
Figure 3:
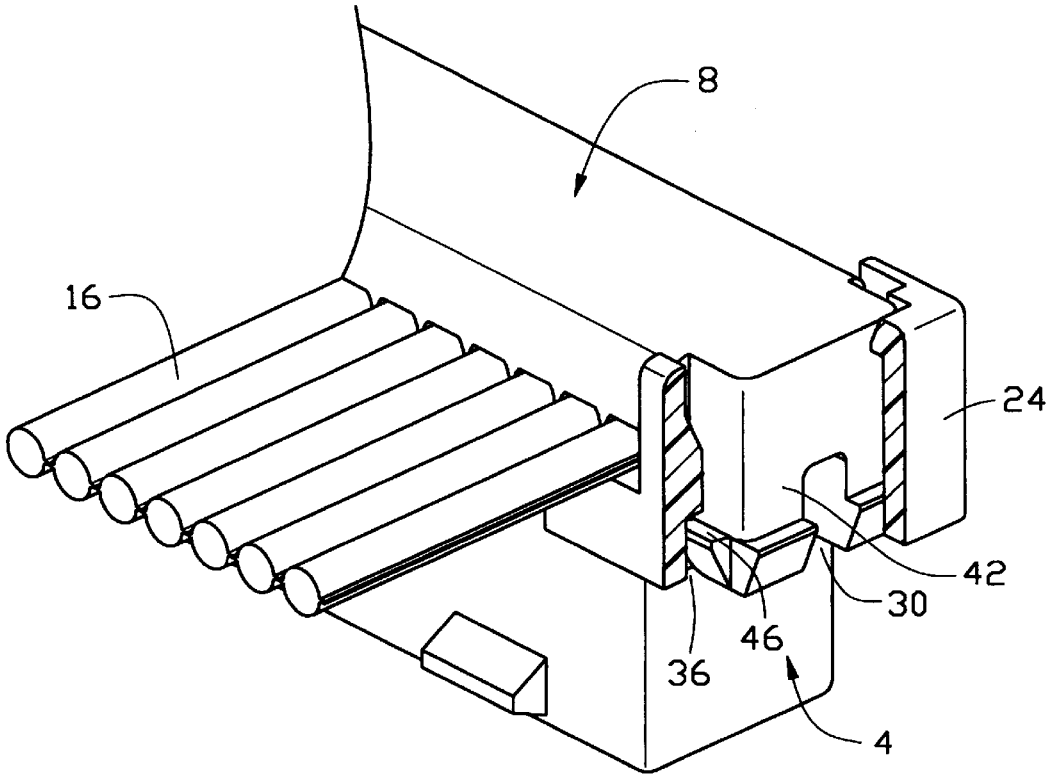
FIG. 3 is a fragmentary assembled view of the cover and the housing with a flat cable secured therebetween with the cover fully engaged with the housing.
Figure 4:
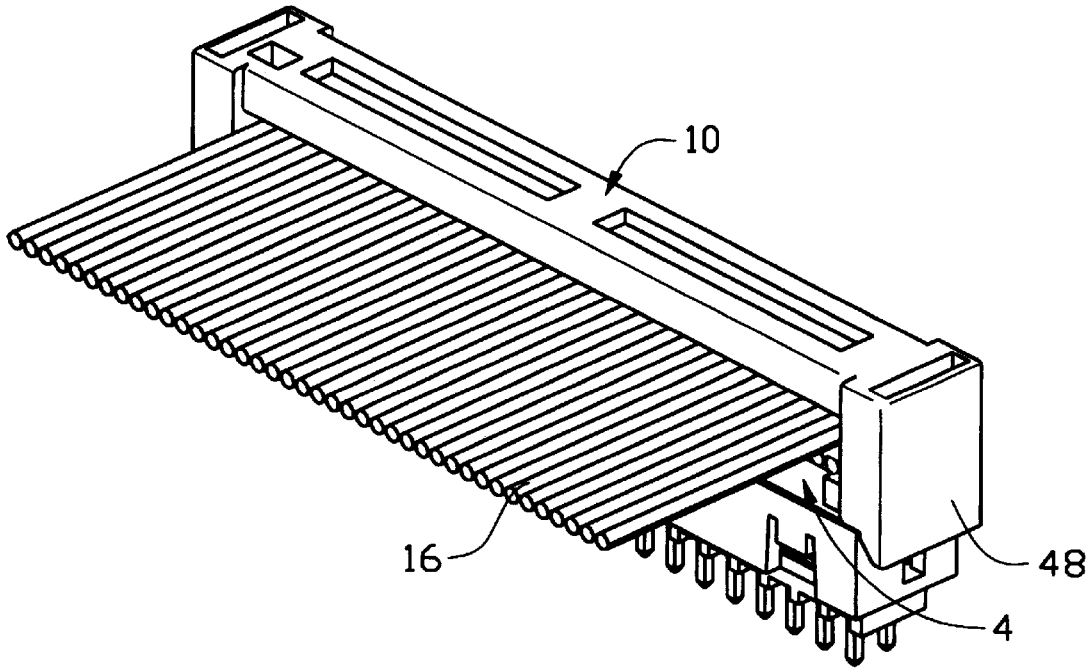
FIG. 4 is an assembled view of FIG. 1 with the flat cable secured therein.
Figure 5:
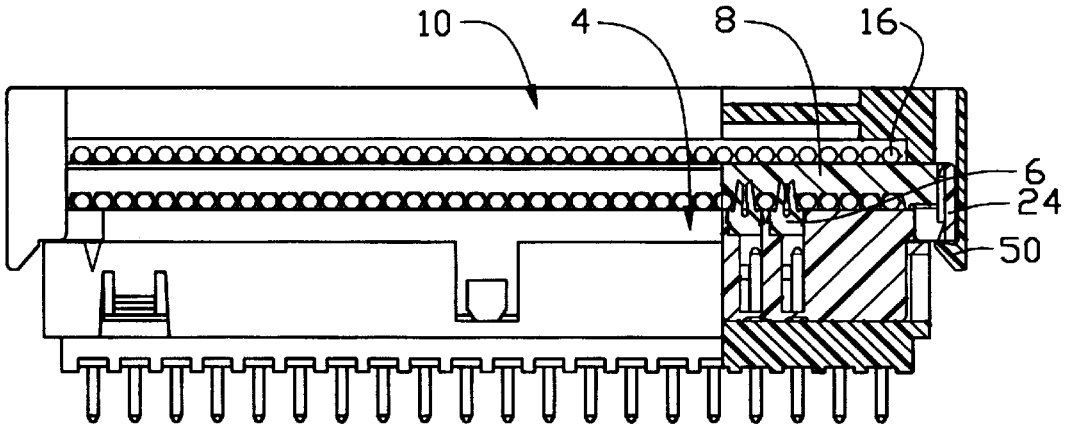
FIG. 5 is a front plan view of the FIG. 4 shown in partial cross section.

Referring to FIG. 1, an IDC connector 2 of the present invention includes a housing 4 retaining a plurality of contacts 6 therein, a cover 8 to be assembled on the housing 4, and a strain relief 10 to be attached to the cover 8. The housing 4 is elongate and forms two rows of slots 12 along a longitudinal direction thereof. The slots 12 are defined between top and bottom surfaces of the housing 4. The contacts 6 are received in the corresponding slots 12 and each contact 6 has an IDC portion 14 projecting beyond the top surface of the housing 4 for insulation displacement connection with a flat cable 16 (FIG. 5). A pair of engaging protrusions 18 and a positioning protrusion 20 are formed on one side wall of the housing 4 for coupling with a complementary connector 22. The housing 4 includes a pair of U-shaped arms 24 at opposite ends thereof. Each arm 24 includes a pair of opposite side walls 26 and a connecting wall 28 between the opposite side walls 26 to define a receiving space 30 therebetween. A pair of barbs 32 is formed on a top portion of the connecting wall 28 and projects into the receiving space 30. A first cutout 34 is formed in a top portion of each side wall 26, and a second cutout 36 is formed in a bottom portion of each side wall 26 in alignment with the first cutout 34.

The cover 8 is elongate and forms a plurality of trenches 40 in a bottom surface thereof extending in a lateral direction orthogonal to a longitudinal direction thereof. A pair of fasteners 42 is formed at each of end of the cover 8 for insertion into the receiving space 30 of the corresponding arm 24. Each fastener 42 includes a first projection 44 and a second projection 46 formed on adjacent side surfaces thereof. The first and second projections orthogonal with each other.

The strain relief 10 includes an elongate body 47 and a pair of legs 48 extending from opposite ends of the body 47. Each leg 48 has a generally U-shaped configuration including a connection wall 53 bridging the two side walls 52. A latch 50 integrally and inwardly projects from an inner face of the connecting wall 53 between the two side walls 52. By such design, the connection between the latch 50 and the body 47 is improved thereby preventing damage from being incurred on the latch 50. The latches 50 each have a large contact surface (not labeled) for engaging with a bottom face of a corresponding U-shaped arm 24 of the housing 4 (FIG. 5), thereby ensuring a reliable connection between the housing 4, the cover 8 and the strain relief 10 when an external force is exerted thereon.

Referring to FIGS. 2-5, in assembly, the fasteners 42 of the cover 8 are inserted into the receiving space 30 of the corresponding arms 24 of the housing 4 to assemble the cover 8 thereon. When the fasteners 42 are initially inserted into the receiving space 30, the pair of first projections 44 of each fastener 42 engages with the pair of barbs 32 of each arm 24. The pair of second projections 46 of each fastener 42 is received in the pair of first cutouts 34 and abuts against the steps 35 of the side walls 26 of each arm 24.

The fasteners 42 are then fully inserted into the receiving space 30 after the flat cable 16 is arranged between the trenches 40 of the cover 8 and the IDC portions 14 of the contacts 6. The flat cable 16 has an insulation displacement connection with the contacts 6. The second projections 46 of each fastener 42 are securely received in the second cutouts 36 of each arm 24. The strain relief 10 is attached to the cover 8, after the flat cable 16 is arranged to enclose rear and top surfaces of the cover 8. The latches 50 of the strain relief

10 securely engage with the arms 24 of the housing 4 to complete assembly of the IDC connector 2. The side walls 52 of the strain relief 10 respectively abut against the corresponding side walls 26 of the housing 4 to resist rotation tendency of the strain relief 10 with regard to the housing 4 due to pull forces applied to the flat cable 16.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

What is claimed is:

1. An IDC connector for use with a flat cable, comprising:

a housing retaining a plurality of contacts therein and including a pair of arms on opposite ends thereof, a pair of barbs formed on a top portion of each the arms and a pair of cutouts formed on a lower portion of each of the arms;

a cover assembled to the housing and forming a pair of fasteners at each end thereof, each fastener including a first projection for securely engaging with the barb and a second projection on adjacent side surfaces thereof; and a strain relief attached to the cover, and including an elongate body and a pair of legs extending from opposite ends of the body, each leg including a generally U-shaped configuration including a connecting wall bridging two side walls, a latch integrally inwardly extending from an inner surface of the connecting wall for engaging with the arm of the housing; wherein said side walls of each leg of the strain relief respectively abut against the corresponding arm of the housing for resisting rotation tendency of the strain relief with regard to the housing due to a pull force applied to the flat cable;

wherein each arm is U-shaped and includes a pair of opposite side walls and a connecting wall between the opposite side walls to define a receiving space therebetween for receiving the corresponding fastener of the cover;

wherein the barbs are formed on a top portion of the connecting wall of the arm and project into the receiving space for securely engaging with the first projections of the corresponding fastener of the cover;

wherein a cutout is formed in a portion of each side wall of the arm for receiving the second projections of the corresponding fastener of the cover when the first projections of the fasteners engage with the corresponding barbs of the arm;

wherein the side walls of the legs of the strain relief abut against the side walls of the respective arms of the housing;

wherein each latch of the strain relief has a large contact surface for ensuring a reliable connection between the strain relief and the housing.

* * * * *